US010415764B1

(12) United States Patent
Lei

(10) Patent No.: US 10,415,764 B1
(45) Date of Patent: Sep. 17, 2019

(54) LED LAMP BULB

(71) Applicant: Dongguan Miray E-Tech Co., Ltd, Dongguan, Guangdong (CN)

(72) Inventor: Jianwen Lei, Guangdong (CN)

(73) Assignee: DONGGUAN MIRAY E-TECH CO., LTD, Dongguan, Guangdong (CN)

( * ) Notice: Subject to any disclaimer, the term of this patent is extended or adjusted under 35 U.S.C. 154(b) by 0 days.

(21) Appl. No.: 16/217,313

(22) Filed: Dec. 12, 2018

Related U.S. Application Data

(63) Continuation-in-part of application No. 16/103,066, filed on Aug. 14, 2018.

(30) Foreign Application Priority Data

Jul. 7, 2018 (CN) ..... 2018 1 0739971

(51) Int. Cl.
*F21K 9/232* (2016.01)
*F21K 9/238* (2016.01)
*F21K 9/235* (2016.01)

(52) U.S. Cl.
CPC ..... *F21K 9/232* (2016.08); *F21K 9/235* (2016.08); *F21K 9/238* (2016.08)

(58) Field of Classification Search
CPC ..... F21K 9/232; F21K 9/235; F21K 9/238; F21K 9/90; F21V 17/101; F21V 17/05; F21V 19/003; F21V 3/02; F21V 3/061
See application file for complete search history.

(56) References Cited

U.S. PATENT DOCUMENTS 5,186,669 A * 2/1993 Holman ..... H01J 9/395 445/16
10,247,365 B2 * 4/2019 Liu ..... F21V 19/005
2003/0062833 A1 * 4/2003 Tai ..... H01K 3/12 313/578
2005/0258038 A1 * 11/2005 Harima ..... G01N 27/4168 204/412
2006/0214551 A1 * 9/2006 Watanabe ..... H01J 9/247 313/318.01

* cited by examiner

*Primary Examiner* — Ali Alavi
(74) *Attorney, Agent, or Firm* — Enshan Hong; VLP Law Group LLP

(57) ABSTRACT

An LED lamp comprising a lamp shade, a lamp cap, a glass core column, and an LED lamp filament, with the glass core column comprising a glass flare tube, a first conducting wire, a second conducting wire and an exhaust tube, the glass flare tube and the exhaust tube being sintered into a core column body, the first conducting wire and the second conducting wire being fixed on both sides of the core column body through welding respectively, and lower end portions of the first conducting wire and the second conducting wire being fixed on the lamp cap through welding respectively, both ends of the LED lamp filament being fixed on the first conducting wire and the second conducting wire through welding respectively, and the second conducting wire being provided with one or more LED lamp bulb drive elements with a drive chip and a resistance element.

4 Claims, 3 Drawing Sheets

LED LAMP BULB

CROSS REFERENCE TO RELATED APPLICATIONS

This application is a continuation-in-pat of U.S. patent application Ser. No. 16/103066 filed on Aug. 14, 2018, which claimed priority from China Patent Application Serial Number 2018/10739971.6, which was filed on Jul. 7, 2018, the entire content of which is herein incorporated as reference.

BACKGROUND OF THE INVENTION

1. Technical Field

The present disclosure relates to the field of a light emitting diode (LED) lamp bulb technology, and in particular to an LED lamp bulb.

2. Background Art

LED lamps feature high efficiency, energy saving and environmental protection and so on. Along with popularization of LED technology, LED lamp bulbs are adopted in many illumination fields to replace traditional incandescent lamps at present. Usually, an LED lamp bulb includes a lamp cap, a lamp shade, an LED lamp core and an electronic element. The manufacturing of the LED lamp bulb needs to be completed through a plurality of procedures. An electronic element of a traditional LED lamp bulb is usually mounted inside a lamp cap. During an assembly process, a special locating device is needed, which increases difficulty of the assembly process and lowers production efficiency. Further, the electronic element itself is high in cost. Therefore, how to lower the production cost of the LED lamp bulb in a violently competitive environment becomes a hotspot to be focused on in the market.

SUMMARY OF THE INVENTION

The present disclosure provides an LED lamp bulb.

An LED lamp bulb includes a lamp shade, a lamp cap, a glass core column, an LED lamp filament. The bottom of the glass core column is integrally sintered with the bottom of the lamp shade, the glass core column includes a glass flare tube, a first conducting wire, a second conducting wire and an exhaust tube, the glass flare tube and the exhaust tube are sintered into a core column body through high temperature, the first conducting wire and the second conducting wire are perpendicularly fixedly sintered to both sides of the core column body respectively, and lower end portions of the first conducting wire and the second conducting wire are fixed on the lamp cap through welding respectively. Both ends of the LED lamp filament are fixed on the first conducting wire and the second conducting wire through welding, and the second conducting wire is provided with one or more LED lamp bulb drive elements with a drive chip and a resistance element.

A length of the first conducting wire is shorter than that of the second conducting wire, and upper end portions of the first conducting wire and the second conducting wire are both bent by 90 degrees to facilitate fixing one or more LED lamp filaments through welding.

Further, the LED lamp bulb drive element may be provided in the middle or a lower portion of the second conducting wire. When the LED lamp bulb drive element is provided in the middle portion of the second conducting wire, the LED lamp bulb drive element is located above the top of the core column body; when the LED lamp bulb drive element is provided at the lower portion of the second conducting wire, the LED lamp bulb drive element is located inside the lower part of the glass flare tube of the core column body.

Preferably, the first conducting wire is taken as a negative pole, the second conducting wire is taken as a positive pole, the lower end portion of the first conducting wire is fixed on a side wall of the lamp cap through welding, and the lower end portion of the second conducting wire is fixed exactly beneath the lamp cap through welding.

An automatic production process for producing the above LED lamp bulb may include the following steps:

At step (1), the glass core column with a drive chip and a resistance element is automatically fabricated as follows: putting the glass flare tube, the first conducting wire, the second conducting wire with a drive chip and a resistance element, and the exhaust tube required for fabrication of the glass core column into a firing mould of a multi-position automatic rotating machine in sequence, moulding the upper ends of the glass flare tube and the exhaust tube with the first conducting wire and the second conducting wire with a drive chip and a resistance element by fusing and flattening with low-to-high-temperature flame and moving the glass core column onto a conveying device by use of an automatic clamping arm to convey the glass core column to the next processing procedure.

At step (2), the LED lamp filament is automatically welded: the LED lamp filament is fixed between the first conducting wire and the second conducting wire by an automatic welding machine to form a LED lamp core together with the glass core column and then automatically conveyed to a sealing and exhausting machine.

At step (3), automatic sealing, exhausting and gas filling are performed for the lamp shade and the lamp core for protection: inserting the LED lamp core into the lamp shade from a lower opening of the lamp shade, sintering the lower opening of the lamp shade by heating with high-temperature flame so that the lower opening of the lamp shade and the glass core column are sintered integrally to form the LED lamp bulb body; vacuumizing the LED lamp bulb body by using a vacuum exhausting device, and then injecting an inert gas through the exhaust tube and fusing and sealing the exhaust tube by heating with high-temperature flame to form an unfinished LED lamp bulb and then conveying the unfinished LED lamp bulb to an automatic cap-installing machine.

At step (4), the lamp cap is automatically installed: energizing the unfinished LED lamp bulb for test to automatically identify defective products, installing the lamp cap onto an unfinished LED lamp bulb that can emit light normally and then fixing the lamp cap by heating adhesive inside the lamp cap through high temperature and then automatically welding solder points of the positive and negative poles to form a finished LED lamp bulb.

At step (5), test and packaging are performed automatically: re-energizing the finished LED lamp bulb for test and moving a finished LED lamp bulb that can emit light normally to a product packaging line to complete production of the LED lamp bulb.

Further, an automatic clamping arm and a conveying device for moving a product are installed between two procedures and the conveying device is provided with product clamping tools and fixtures required for a corresponding procedure.

Further, the glass flare tube, the first conducting wire, the second conducting wire with a drive chip and a resistance element and an exhaust tube are placed in one automatic unloading device respectively. The multi-position automatic rotating machine performs cyclic rotating movements. When the multi-position rotating machine moves one position, an automatic unloading device corresponding to the firing mould may automatically drop one part.

Further, before the LED lamp filament is welded at step (2), a step of straightening and cutting the first conducting wire and the second conducting wire may also be performed as follows: fixing the glass core column at a moving working position of the welding machine perpendicularly so that the upper end portion of the glass core column goes through shaping processes of a plurality of corresponding locating parts, thereby keeping the first conducting wire and the second conducting wire in an upright state, ensuring that the LED lamp filament is accurately and tightly welded into a lamp core.

Further, at step (3), a sintering process of the lamp shade and the lamp core may sequentially include a pre-sintering step, a high-temperature sintering step and an annealing sintering step, and flame strengths of the pre-sintering step and the annealing sintering step are less than a flame strength of the high-temperature sintering step.

Further, at step (4), when the unfinished LED lamp bulb is conveyed to the lamp-cap installing machine, the unfinished LED lamp bulb is inversely placed firstly so that the lower end portions of the first conducting wire and the second conducting wire faces upward; then horizontal movement is performed, and preparation work before the lamp cap is installed is performed for the unfinished LED lamp bulb in a sequence as follows:

A. bottom conducting wires of the unfinished LED lamp bulb are brushed straight by using brush wheels;

B. the first conducting wire and the second conducting wire are straightened by using two brush wheels installed correspondingly;

C. the first conducting wire and the second conducting wire are separated by a poking rod, the first conducting wire serves as the negative pole and the second conducting wire serves as the positive pole, and the lower end portion of the first conducting wire is bent downwardly close to the unfinished LED lamp bulb by the poking rod;

D. the second conducting wire is straightened upwardly by use of a pneumatic clip;

E. the unfinished LED lamp bulb is energized to test whether the LED lamp core is good;

F. if the LED lamp core is detected not to emit light at a previous working position, the unfinished LED lamp bulb is blown into a defective product collection box by a high-pressure air nozzle; if the LED lamp core can emit light normally, the unfinished LED lamp bulb is moved to a next working position;

G. the lamp cap is put in place by the automatic clamping arm and then the product is conveyed into each locating mould for fixing, redundant parts of the lower end portions of the first conducting wire and the second conducting wire are cut off and then automatic tin soldering is performed to form a finished LED lamp bulb which is then automatically conveyed to a light tester for sorting;

H. if the finished LED lamp bulb is detected not to emit light at a previous working position, the finished LED lamp bulb is blown into a defective product collection box by a high pressure air nozzle; if the finished LED lamp bulb can emit light normally, the finished LED lamp bulb is moved to a next working position;

I. the lamp cap of the finished LED lamp bulb is fixed by high-temperature flame.

Further, hot melt adhesive is provided on an inner wall of the lamp cap. The lamp cap and the unfinished LED lamp bulb are fixedly bonded by performing jet heating for the lamp cap with high-temperature flame to complete installation work of the lamp cap.

Further, an LED light emission sensor is installed beside a test position when energization is performed for test; if the LED light emission sensor does not sense emitted light, the LED light emission sensor will send instructions to control the high-pressure air nozzle to blow air.

Preferably, the drive chip and the resistance element of the second conducting wire may be pre-fired into one electronic element, and the electronic element is located above the top of the core column or inside the lower part of the glass flare tube.

Beneficial effects:

According to an LED lamp bulb provided in the present disclosure, a connection of an electronic element performed inside a lamp cap in the prior art is saved by pre-installing an LED lamp bulb drive element with a drive chip and a resistance element in the middle of the second conducting wire. Thus, connecting structure and connecting manner of an LED lamp bulb drive element are optimized to facilitate automatic production, thereby improving production efficiency and greatly lowering production costs of LED lamp bulbs.

DETAILED DESCRIPTION OF PREFERRED EMBODIMENTS OF THE INVENTION

Figure 1:
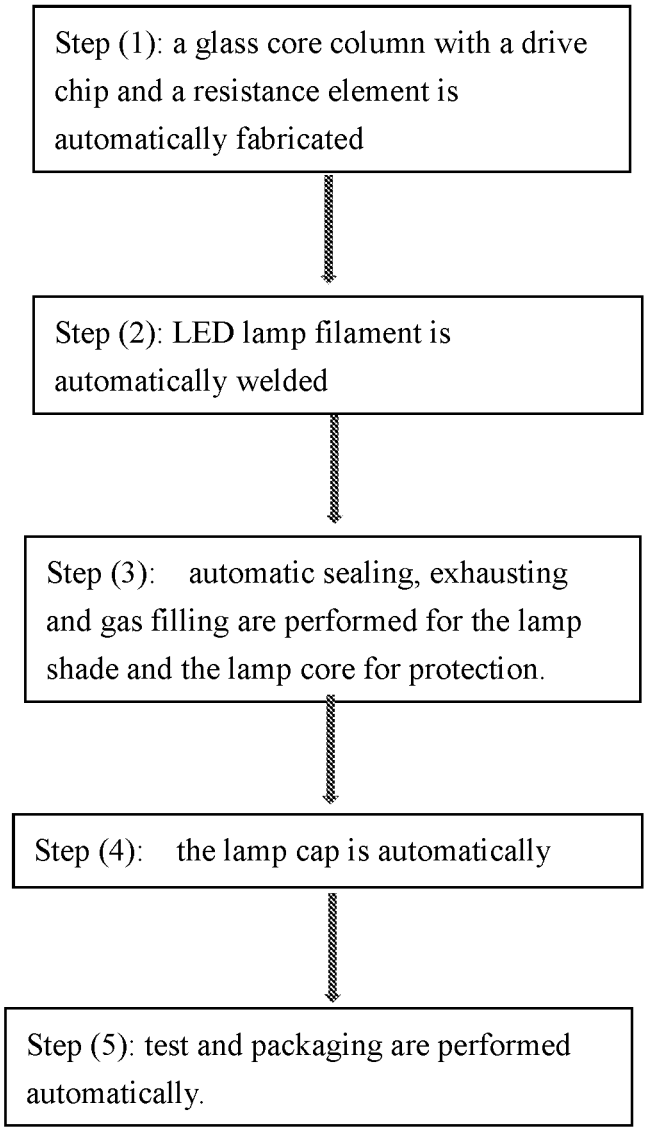
FIG. 1 is a flowchart illustrating an automatic production process of an LED lamp bulb according to an example of the present disclosure.
Figure 2:
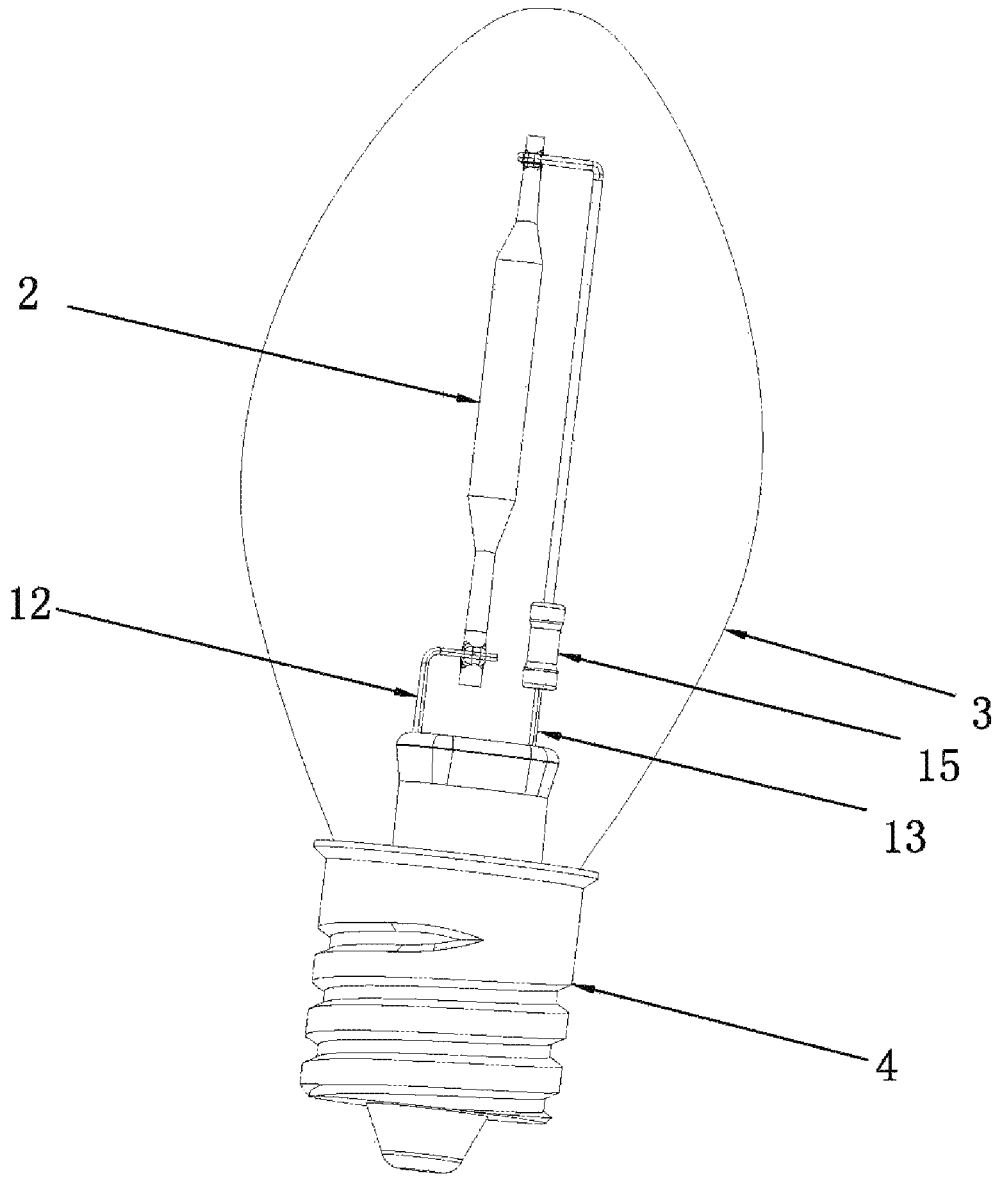
FIG. 2 is a schematic diagram illustrating a structure of an LED lamp core according to an example of the present disclosure.

To help those skilled in the art to better understand the technical solutions of the present disclosure, the present disclosure will be further described below in combination with examples and drawings. The contents in the examples are not intended to limit the present disclosure. The present disclosure is detailed below in combination with the drawings.

In the drawings 1-3, 1 is a glass core column, 11 is a glass flare tube, 12 is a first conducting wire, 13 is a second conducting wire, 14 is an exhaust tube, 15 is an LED lamp bulb drive element, 2 is an LED lamp filament, 3 is a lamp shade, and 4 is a lamp cap.

The present disclosure provides an LED lamp bulb, including a lamp shade 3, a lamp cap 4, a glass core column 1 and an LED lamp filament 2. The bottom of the glass core column 1 is sintered integrally with the bottom of the lamp cap 3, the glass core column 1 includes a glass flare tube 11, a first conducting wire 12, a second conducting wire 13 and an exhaust tube 14, the glass flare tube 11 and the upper part of the exhaust tube 14 are sintered through high temperature into a core column body, the first conducting wire 12 and the second conducting wire 13 are perpendicularly fixedly sintered to both sides of the core column body respectively and lower end portions of the first conducting wire 12 and the second conducting wire 13 are fixed on the lamp cap through welding respectively. Both ends of the LED lamp filament 2 are fixed on the first conducting wire 12 and the second conducting wire 13 through welding and the second conducting wire 13 is provided with one or more LED lamp bulb drive elements 15 with a drive chip and a resistance element. According to the present disclosure, a connection of an electronic element performed inside a lamp cap in the prior art is saved by pre-installing an LED lamp bulb drive element 15 with a drive chip and a resistance element in the middle of the second conducting wire 13. Thus, connecting structure and connecting manner of the LED lamp bulb drive element 15 are optimized to facilitate automatic production, thereby improving production efficiency and greatly lowering production costs of LED lamp bulbs.

In the present disclosure, a length of the first conducting wire 12 is shorter than that of the second conducting wire 13 and upper end portions of the first conducting wire 12 and the second conducting wire 13 are both bent by 90 degrees to facilitate fixing one or more LED lamp filaments through welding. As shown in FIG, the LED lamp filament 2 is welded in an upright state and an upper end portion of the LED lamp filament 2 is fixed on an upper end portion of the second conducting wire 13 through welding, and a lower end portion of the LED lamp filament 2 is fixed on an upper end portion of the first conducting wire 12 through welding, thereby facilitating tack welding performed by an automatic welding machine.

Preferably, the first conducting wire 12 is taken as a negative pole, the second conducting wire 13 is taken as a positive pole, the lower end portion of the first conducting wire 12 is fixed on a side wall of the lamp cap 3 through welding and the lower end portion of the second conducting wire 13 is fixedly welded exactly beneath the lamp cap 3.

Figure 3:
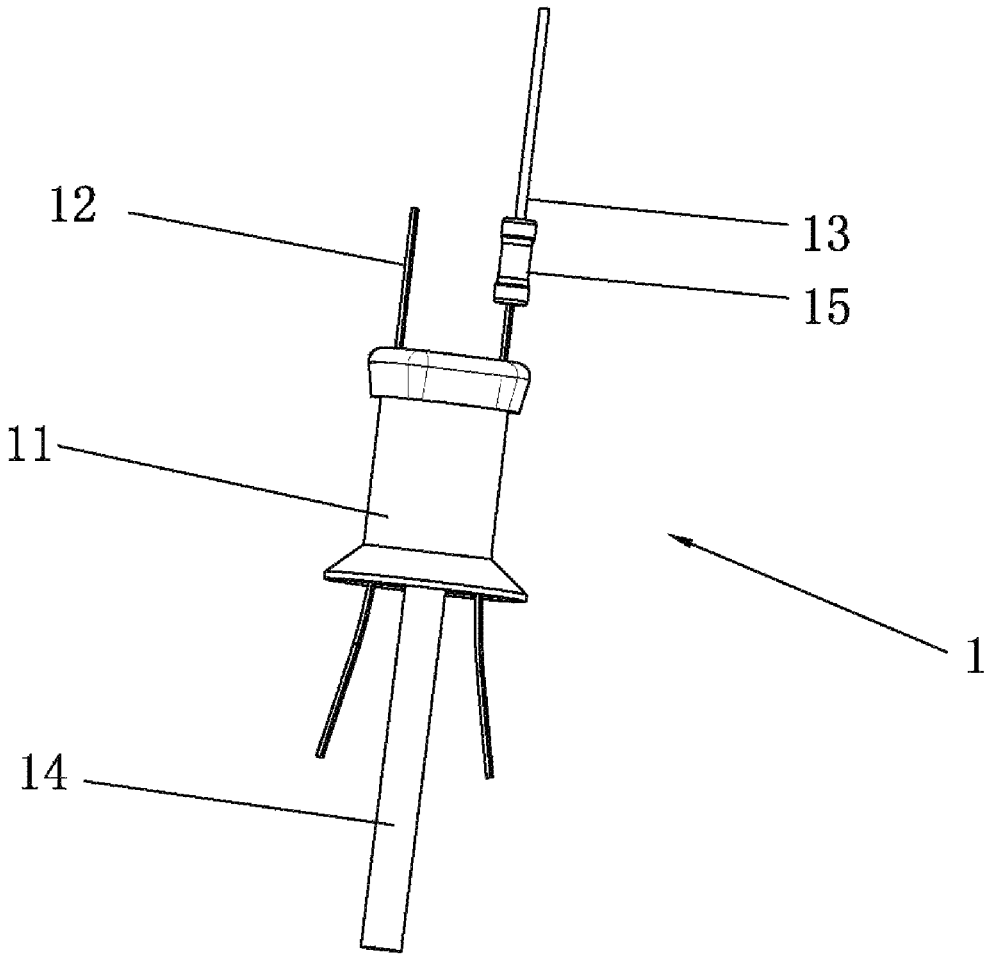
FIG. 3 is a schematic diagram illustrating a structure of an LED lamp bulb according to an example of the present disclosure.

Further, the LED lamp bulb drive element 15 may be provided in the middle or a lower portion of the second conducting wire 13. As shown in FIG. 3, the LED lamp bulb drive element 15 is provided in the middle of the second conducting wire 13 and the LED lamp bulb drive element 15 is located above the top of the core column body. When the LED lamp bulb drive element 15 is provided in the lower portion of the second conducting wire 13, the LED lamp bulb drive element 15 is located inside the lower part of the glass fare tube 11 of the core column body. Since the LED lamp bulb drive element 15 is hidden insides, the LED lamp bulb drive element 15 will not affect the aesthetics of the LED lamp bulb. It is noted that the installation position of the LED lamp bulb drive element 15 may be set based on requirements of a customer and therefore will not be limited to the middle or the lower portion of the second conducting wire 13. Also, the power of the LED lamp bulb will not be affected by the position of the LED lamp bulb drive element 15.

An automatic production process for producing the above LED lamp bulb includes the following steps:

At step (1), the glass core column 1 with a drive chip and a resistance element is automatically fabricated as follows: putting the glass flare tube 11, the first conducting wire 12, the second conducting wire 13 with a drive chip and a resistance element, and the exhaust tube 14 required for fabrication of the glass core column 1 into a firing mould of a multi-position automatic rotating machine in sequence, moulding the upper ends of the glass flare tube 11 and the exhaust tube 14 with the first conducting wire 12 and the second conducting wire 13 with a drive chip and a resistance element by fusing and flattening with low-to-high-temperature flame and then moving the glass core column 1 onto a conveying device by use of an automatic clamping arm to convey the glass core column 1 to the next processing procedure. The glass core column 1 is an inner core of the LED lamp bulb for supporting installation of an LED lamp filament. The automatic production process starts from production of the inner core; the second conducting wire 13 in the present disclosure is pre-fabricated into one conducting wire by use of a conducting wire, a drive chip and a resistance element, without need to perform manual welding on the drive chip and the resistance element, thereby reducing manual procedure of welding the electronic elements through human labor, improving production efficiency of installing the lamp cap subsequently and reducing the costs of installing the lamp cap through human labor. Thus, the glass flare tube 11, the first conducting wire 12, the second conducting wire 13 and the exhaust tube 14 can be automatically manufactured by production equipment. During production, only one worker is needed to manage and control the equipment for automatically manufacturing the glass core column 1. Based on current actual production, 30-40 glass core columns can be produced each minute, greatly improving production efficiency and reducing labor cost of production.

At step (2), the LED lamp filament 2 is automatically welded: the LED lamp filament 2 is fixed between the first conducting wire 12 and the second conducting wire 13 with a drive chip and a resistance element by an automatic welding machine to form a LED lamp core together with the glass core column 1 and then automatically conveyed to a sealing and exhausting machine. The LED lamp filament 2 is a straight-strip illuminant. It is only required to fix both ends of the LED lamp filament 2 through welding. The welding can be completed quickly by use of the automatic welding machine. During welding, only one worker is needed to manage and control the automatic welding machine. 30-40 LED lamp filaments 2 can be fixedly welded per minute, which greatly improves production efficiency and lowers the labor cost of production over traditional manual welding.

At step (3), automatic sealing, exhausting and gas filling are performed for the lamp shade and the lamp core for protection: inserting the LED lamp core into the lamp shade 3 from a lower opening of the lamp shade 3 firstly on a sealing and exhausting machine, sintering the lower opening of the lamp shade 3 by heating with high-temperature flame so that the lower opening of the lamp shade 3 and the glass core column 1 are sintered integrally to form an LED lamp bulb body; vacuumizing the LED lamp bulb body by using a vacuum exhausting device, and then injecting an inert gas through the exhaust tube and fusing and sealing the exhaust tube 14 by heating with high-temperature flame to form an unfinished LED lamp bulb and then conveying the unfinished LED lamp bulb to an automatic cap-installing machine.

At step (4), the lamp cap 4 is automatically installed: energizing the unfinished LED lamp bulb for test to automatically identify defective products, installing the lamp cap 4 onto an unfinished LED lamp bulb that can emit light normally and then fixing the lamp cap 4 by heating adhesive inside the lamp cap through high temperature and then automatically welding solder points of the positive and negative poles to form a finished LED lamp bulb.

At step (5), test and packaging are performed automatically: re-energizing the finished LED lamp bulb for test and moving a finished LED lamp bulb that can emit light normally to a product packaging line to complete production of the LED lamp bulb.

According the above five steps, the first conducting wire 12, the second conducting wire 13 with a drive chip and a resistance element, and the glass core column required for the lamp bulb are produced integrally, and one complete lamp core required for an LED lamp bulb is formed by welding the lamp filament with an automatic welding machine. The LED lamp core is conveyed into an automatic sealing and exhausting machine by an automatic clamping arm and a conveying device and then filled with an inert gas before the exhaust tube 14 is cut off so as to form an unfinished LED lamp bulb. An automation progress of installing the lamp cap onto the unfinished lamp bulb can be achieved by mutual cooperation and setup of corresponding machines in different procedures, greatly improving production efficiency, lowering labor cost, and realizing high-speed high-efficiency and high-quality production of LED lamp bulbs. The full automatic production process reduces human costs and eliminates uncertainty of quality and can achieve uninterrupted production at a full day, thereby greatly lowering human costs, and improving production efficiency and quality.

In the present disclosure, an automatic clamping arm and a conveying device for moving a product are installed between two procedures and the conveying device is provided with product clamping tools and fixtures required for a corresponding procedure. The present disclosure realizes automatic operation of different procedures by replacing human handling with the automatic clamping machine and the conveying device.

Further, the glass flare tube 11, the first conducting wire 12, the second conducting wire 13 with a drive chip and a resistance element and an exhaust tube 14 are placed in one automatic unloading device respectively. The multi-position automatic rotating machine performs cyclic rotating movements. When the multi-position rotating machine moves one position, an automatic unloading device corresponding to the firing mould may automatically drop one part.

Further, before the LED lamp filament 2 is welded at step (2), a step of straightening and cutting the first conducting wire 12 and the second conducting wire 13 may also be performed as follows: fixing the glass core column 1 on a moving working position of the welding machine perpendicularly so that the upper end portion of the glass core column goes through shaping processes of a plurality of corresponding locating parts, thereby keeping the first conducting wire 12 and the second conducting wire 13 in an upright state, guaranteeing the LED lamp filament is accurately and tightly welded into a lamp core. Since the first conducting wire 12 and the second conducting wire 13 may not be in an upright state when being fixed on the glass core column 1, the upper end portion of the glass core column 1 needs to go through a shaping process of locating parts so that brush wheels can brush straight the first conducting wire 12 and the second conducting wire 13. Thus, both ends of the LED lamp filament 2 can be in full contact with the first conducting wire 12 and the second conducting wire 13.

Further, a sintering process of the lamp shade and the lamp core may sequentially include a pre-sintering step, a high-temperature sintering step and an annealing sintering step, and flame strengths of the pre-sintering step and the annealing sintering step are less than a flame strength of the high-temperature sintering step.

Further, at step (4), when the unfinished LED lamp bulb is conveyed to the lamp-cap installing machine, the unfinished LED lamp bulb is inversely placed firstly so that the lower end portions of the first conducting wire and the second conducting wire face upward; then horizontal movement is performed and preparation work before the lamp cap is installed is performed for the unfinished LED lamp bulb in a sequence as follows:

A. bottom conducting wires of the unfinished LED lamp bulb are brushed straight by using brush wheels;

B. the first conducting wire 12 and the second conducting wire 13 are straightened by using two brush wheels installed correspondingly;

C. the first conducting wire 12 and the second conducting wire 13 are separated by a poking rod, the first conducting wire 12 serves as the negative pole and the second conducting wire 13 serves as the positive pole, and the lower end portion of the first conducting wire 12 is bent downwardly close to the unfinished LED lamp bulb by the poking rod;

D. the second conducting wire 13 is straightened upwardly by use of a pneumatic clip.

E. the unfinished LED lamp bulb is energized to test whether the LED lamp core is good;

F. if the LED lamp core is detected not to emit light at a previous working position, the unfinished LED lamp bulb is blown into a defective product collection box by a high-pressure air nozzle; if the LED lamp core can emit light normally, the unfinished LED lamp bulb is moved to a next working position;

G. the lamp cap 4 is put in place by the automatic clamping arm and then the product is conveyed into each locating mould for fixing, redundant parts of the lower end portions of the first conducting wire 12 and the second conducting wire 13 are cut off and then automatic tin soldering is performed to form a finished LED lamp bulb which is then automatically conveyed to a light tester for sorting;

H. if the finished LED lamp bulb is detected not to emit light at a previous working position, the finished LED lamp bulb is blown into a defective product collection box by a high pressure air nozzle; if the finished LED lamp bulb can emit light normally, the finished LED lamp bulb is moved to a next working position;

I. the lamp cap 4 of the finished LED lamp bulb is fixed by high-temperature flame.

Further, hot melt adhesive is provided on an inner wall of the lamp cap 4. The lamp cap 4 and the unfinished LED lamp bulb are fixedly bonded by performing jet heating for the lamp cap with high-temperature flame to complete installation work of the lamp cap 4. The key for the lamp bulb to emit light normally is to correctly install the lamp cap 4 onto the unfinished LED lamp bulb. Since many steps of installing the lamp cap 4 are to be performed, at least five to seven workers are needed to cooperate in a work flow for traditional manual installation of the lamp cap 4. The manual installation of the lamp cap 4 results in lower production efficiency and higher labor investment. The full automatic production process of automatically installing the lamp cap 4 as above replaces manual operation in traditional production process, greatly improving production efficiency and saving labor costs. Also, stable quality of the finished LED lamp bulbs can be achieved at the same time.

Further, an LED light emission sensor is installed beside a test position when energization is performed for test; if the LED light emission sensor does not sense emitted light, the LED light emission sensor will send instructions to control the high-pressure air nozzle to blow air. Defective products can be eliminated automatically by sensing light through an LED light emission sensor.

Preferably, the drive chip and the resistance element of the second conducting wire 13 may be pre-fired into one electronic element and the electronic element is located above the top of the core column or inside the lower part of the glass flare tube.

In conclusion, the above are merely preferred examples of the present disclosure and not intended to limit the present disclosure in any form. Although the present disclosure is made with preferred examples, the preferred examples are not intended to limit the present disclosure. Those skilled in the art may make some changes or modifications to the present disclosure as equivalent examples based on technical contents as disclosed above without departing from the scope of protection of the present disclosure. Any simple modification, equivalent changes or modifications made based on the technical solutions of the present disclosure without departing from the contents of the technical solutions of the present disclosure shall all fall within the scope of protection of the present disclosure.

What is claimed is:

1. A Light Emitting Diode (LED) lamp bulb comprising a lamp shade, a lamp cap, a glass core column, and an LED lamp filament, wherein:

the bottom of the glass core column is sintered integrally with the bottom of the lamp shade, the glass core column comprises a glass flare tube, a first conducting wire, a second conducting wire and an exhaust tube, the glass flare tube and the exhaust tube are sintered into a core column body, the first conducting wire and the second conducting wire are fixedly welded on both sides of the core column body perpendicularly, lower end portions of the first conducting wire and the second conducting wire are fixed on the lamp cap through welding respectively, both ends of the LED lamp filament are fixed on the first conducting wire and the second conducting wire through welding respectively, and the second conducting wire is provided with one or more LED lamp bulb drive elements with a drive chip and a resistance element.

2. The LED lamp bulb according to claim 1, wherein a length of the first conducting wire is shorter than a length of the second conducting wire, and upper end portions of the first conducting wire and the second conducting wire are both bent by 90 degrees to facilitate fixing one or more LED lamp filaments through welding.

3. The LED lamp bulb according to claim 1, wherein the LED lamp bulb drive element is provided in the middle or at a lower portion of the second conducting wire, when the LED lamp bulb drive element is provided in the middle of the second conducting wire, the LED lamp bulb drive element is located above the top of the core column body, and when the LED lamp bulb drive element is provided at the lower portion of the second conducting wire, the LED lamp bulb drive element is located inside the lower part of the glass flare tube of the core column body.

4. The LED lamp bulb according to claim 1, wherein the first conducting wire is taken as a negative pole, the second conducting wire is taken as a positive pole, the lower end portion of the first conducting wire is fixed on a side wall of the lamp cap through welding, and the lower end portion of the second conducting wire is fixedly welded exactly beneath the lamp cap.

* * * * *